US008232466B2

(12) United States Patent
Slick et al.

(10) Patent No.: US 8,232,466 B2
(45) Date of Patent: Jul. 31, 2012

(54) HAND-MOUNTABLE NOISE MAKER

(75) Inventors: George H. Slick, Glen Mills, PA (US); Gertrude M. Slick, Glen Mills, PA (US); Geoffrey W. Slick, Schwenksville, PA (US); Robert G. Slick, Georgetown, SC (US)

(73) Assignee: George H. Slick, et al., Glen Mills, PA (US)

( * ) Notice: Subject to any disclaimer, the term of this patent is extended or adjusted under 35 U.S.C. 154(b) by 2 days.

(21) Appl. No.: 12/868,898

(22) Filed: Aug. 26, 2010

(65) Prior Publication Data

US 2011/0061512 A1 Mar. 17, 2011

Related U.S. Application Data

(60) Provisional application No. 61/241,536, filed on Sep. 11, 2009.

(51) Int. Cl.
*G10D 3/04* (2006.01)

(52) U.S. Cl. ..... 84/402

(58) Field of Classification Search ..... 84/402–410
See application file for complete search history.

(56) References Cited

U.S. PATENT DOCUMENTS 2,472,408 A * 6/1949 Di Angelo ..... 446/421
D410,702 S 6/1999 Spear

* cited by examiner

*Primary Examiner* — Kimberly Lockett
(74) *Attorney, Agent, or Firm* — Glenn M. Massina; Fox Rothschild LLP

(57) ABSTRACT

A sound generating device for being removably securable to or directly about a person's hand or finger for producing sound when the hand is reciprocally moved. The device includes a sound generating portion secured or securable to an attachment portion, where the attachment portion is securable to or directly about the hand or finger. Preferably, the sound is percussive caused by components of the device striking each other upon rapid and repeated reciprocal hand movement. The device is light in weight, does not require striking the hand or finger or other portion of the body, and is shaped and contoured to conform to hand shape, and preferably includes an adjustable attachment portion to adapt to differing sizes and shapes of hands and fingers; the device also may be modular, wherein the attachment portion may comprise a plurality of differing sizes of mounting structures for the same sound generating portion.

22 Claims, 8 Drawing Sheets

HAND-MOUNTABLE NOISE MAKER

CROSS-REFERENCE TO RELATED APPLICATIONS

This application claims priority from U.S. Provisional Patent Application Ser. No. 61/241,536 filed Sep. 11, 2009.

FIELD OF THE INVENTION

This relates to the field of novelties and more particularly to devices for generating sound and noise.

BACKGROUND OF THE INVENTION

It is historically evident that popular events such as sporting or celebratory events attract large numbers of spectators, or fans, who enjoy being entertained thereby and also who enjoy displaying their enthusiasm and exuberance such as by cheering, yelling and roaring at times, in encouragement and support of certain teams or individual participants and, upon occasion, in opposition to certain others. Occasionally, such displays including the use of noise-making devices such as airhorns.

It is desired to provide devices that are easily manually activatable to produce certain noises or sounds.

BRIEF SUMMARY OF THE INVENTION

Briefly, the present invention is a hand-mountable or finger-mountable device to produce sound, that is easily mounted onto or directly about the hand or a finger and is easily removable therefrom, or on a glove or mitten worn on the hand, but is not limited thereto. The device includes a sound generating portion and an attachment portion. Preferably, the sound is a percussive sound generated upon shaking of the device or moving and stopping it quickly, and can include clacking, clapping or rattling, for example, but is not limited thereto. The sound can be quite loud for a small, light-weight device especially when a plurality of such devices are activated simultaneously by numerous spectators. Also, preferably, the device is light in weight and not bulky nor cumbersome, does not require striking the hand or body, has hand- or finger-adjacent surfaces that are contoured to conform therewith, and has no sharp edges or corners, thus being ergonomic in design. Further, the device is adapted to accommodate hands and fingers of differing sizes and shapes. The device is easily used merely by rapid, reciprocal hand or finger movement like clapping or waving, thus taking advantage of body movement associated with displays of spectator exuberance to supplement the human voice.

In one embodiment, the device of the present invention is a rattle including a hollow container within which are loose, relatively dense subcomponents such as steel shot, stones or the like, that strike the container walls when the device is shaken quickly. The device further includes an attachment section for securing the device to a person's hand, such as the back of the hand or the several fingers, or even to the back of a glove or mitten worn on the hand, such that when the hand is reciprocally shaken rapidly and repeatedly, the device perforce moves quickly and generates a rattling sound.

In a second embodiment, the device of the present invention is a clacker including a plurality of sections movable with respect to each other, which generate a clacking or clapping sound when each section is moved to strike an adjacent section. The sections may be, for example, relatively planar plates or paddles secured together at first ends thereof while extending to second or free ends, such that the plates may pivot about the secured together ends and strike each other when the device is shaken. The clacker includes an attachment section adapted to be mounted to a selected finger of a hand, or to the back of the hand, but is not limited thereto, and when the hand is reciprocally shaken rapidly and repeatedly, the device perforce moves quickly and generates a clacking or clapping sound. The sound generating portion may be modular and be accompanied by a plurality of attachment portions of varying sizes, or by an adjustable strap.

The device of the present invention also leaves the hands and fingers substantially free for the wearer to grasp other items, and does not substantially encumber the wearer. Furthermore, the device of the present invention can be adapted to commemorate a particular sport or sports team or celebratory event such as by including a decal or illustration or embossment of a team logo or a design associated with the sport or a specific team, or be presented in team or celebratory event colors, or even be ornamentally shaped to support a particular sport or a specific team or celebratory event.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
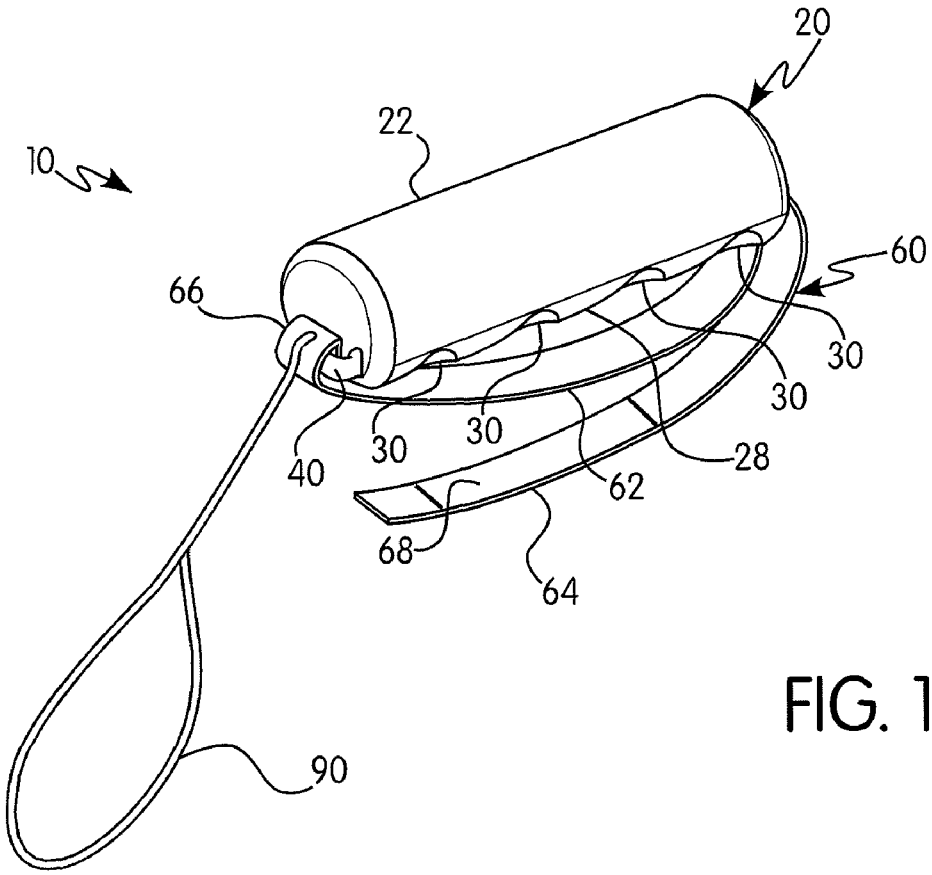
FIGS. 1 and 2 are isometric views of a first embodiment of noise-making device of the present invention having an attachment strap.
Figure 2:
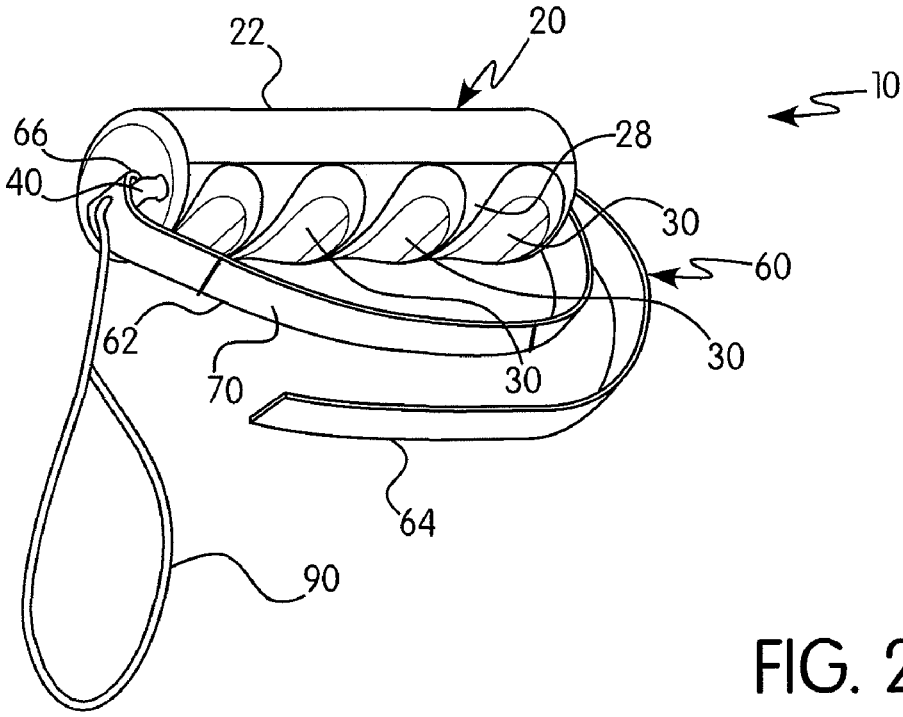
Figure 3:
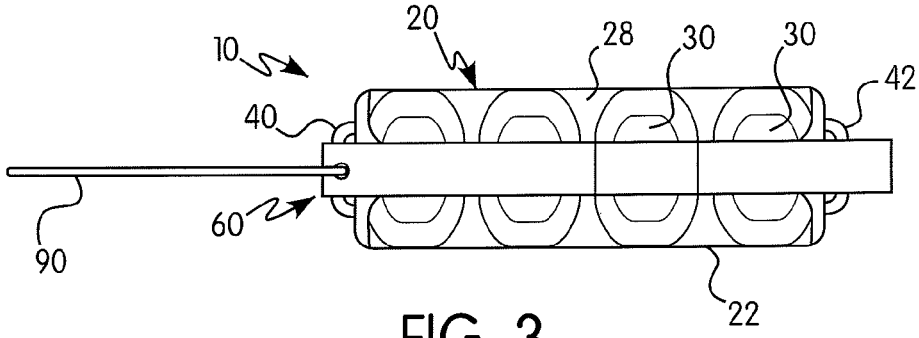
FIGS. 3 and 4 are bottom and side views, respectively, of the device of FIGS. 1 and 2.
Figure 4:
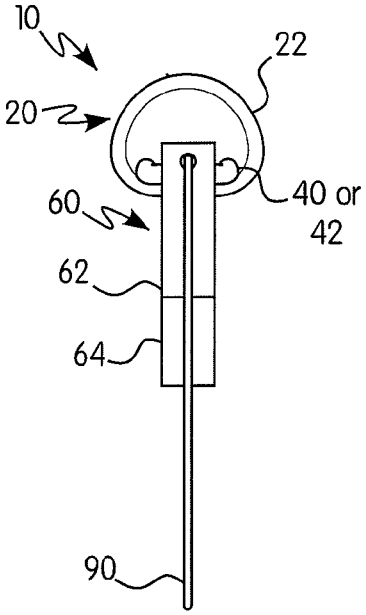

In the drawings, like numerals indicate like elements throughout. Certain terminology is used herein for convenience only and is not to be taken as a limitation on the present invention. The terminology includes the words specifically mentioned, derivatives thereof and words of similar import. The terms and expressions used herein, and the embodiments illustrated below, are not intended to be exhaustive or to limit the invention to the precise form disclosed. These terms, expressions and embodiments are chosen and described to best explain the principle of the invention and its application and practical use and to enable others skilled in the art to best utilize the invention.

FIGS. 1 to 7 illustrate a first basic type of hand-mountable sound generating device of the present invention, where the device is mountable onto or directly about a hand (not shown) to be disposed along the back of the hand or the fingers. FIGS. 8 to 23 are illustrative of a second basic type of sound generating device where the device is mountable onto or directly about a selected finger (not shown), again to be disposed along the back of the finger. Either basic type may optionally include an auxiliary attachment section such as a wrist strap.

In FIGS. 1 to 6, device 10 includes a sound generating portion 20 and an attachment portion 60. Sound generating portion 20 includes a hollow container section 22 within which are disposed one or preferably more subcomponents 24 (FIGS. 5 and 6) that are loose within the interior cavity 26 of container section 22. Being loose, subcomponents 24 will move relative to the container and strike the inside surface of container section 22 producing a sound or noise, whenever the sound generating portion 20 is shaken, or moved quickly and stopped. Container section 22 can preferably be sufficiently long to extend transversely the width of a hand, and can have a hand-engaging surface 28 that is contoured to generally complement the backs of the fingers when mounted on a hand, by having defined thereinto four upward extending indents 30 defined orthogonal to the length of the container.

Hollow container section 22 can comprise an upper body half 32 and a lower body half 34 that are firmly affixed to each other upon assembly such as by being bonded, or being fused or welded. Upper and lower body halves 32,34 can easily be molded from plastic material that is not brittle and has high strength properties so as not to be breakable. Subcomponents 24 preferably are dense, solid members such as steel shot; alternatively, marbles or stones or ceramic pellets can suffice, although plastic pellets would produce noise that is less loud. Their size may vary but preferably subcomponents are substantially smaller than the interior cavity 26 but large enough to make a sharp sound when striking the inside surface of container 22 when the device is shaken.

Figure 5:
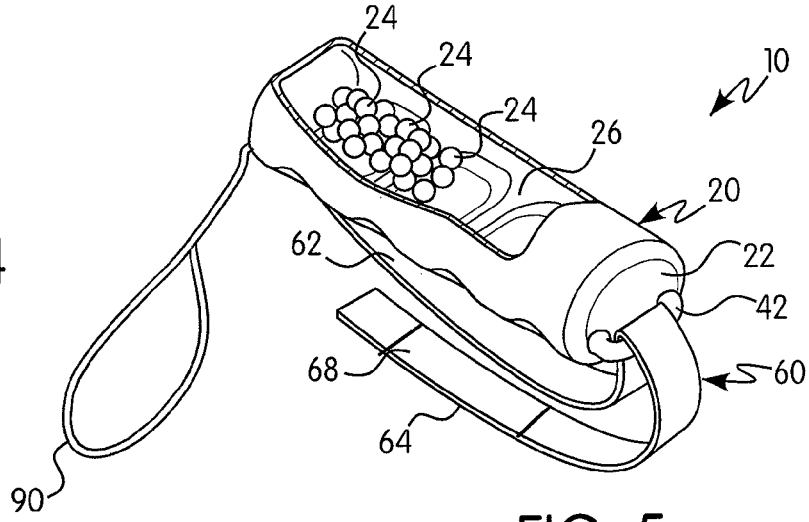
FIG. 5 is a part section isometric view similar to FIG. 1 of the device of FIGS. 1 to 4 and illustrating the interior of the device.
Figure 6:
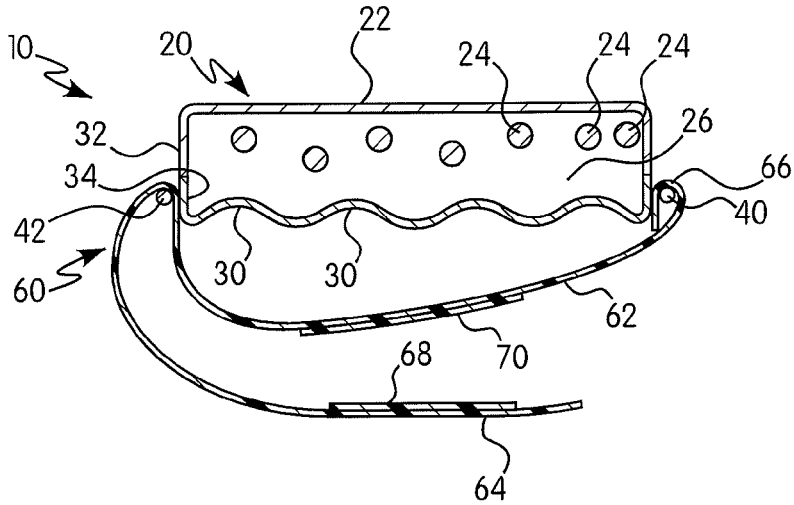
FIG. 6 is a cross-sectioned elevation view of the device of FIGS. 1 to 5.

Attachment region 60 can comprise a strap (see FIG. 23), and is preferably of adjustable length to accommodate different sizes of hands. Preferably, attachment region 60 comprises two strap portions 62,64 such as of VELCRO® (trademark of Velcro Industries B.V., Curacao, Netherlands Antilles) and be of sufficient length for portions 62,64 to overlap for an extended distance to self-secure to each other. The two strap portions, as is shown in FIGS. 5 and 6, may be one continuous integral strap, where a first end 66 is easily affixed to a strap-connecting loop 40 of container 22 and where the strap length is passed through a second strap-connecting loop 42 at the opposite end of the container; strap portion 64 is doubled back over strap portion 62 that extends between the two loops 40,42 and about the hand (not shown), for the hooks on one surface 68 to engage loops on the opposing strap surface 70 (FIG. 6).

The strap may also comprise two separate lengths (not shown) where the first strap ends of the two lengths can easily be affixed to container 22 by being fastened to strap-connecting loops 40,42 of the container at the ends thereof, while the free strap portions overlap to be firmly attached to each other after being wrapped about the hand. As an additional matter, a cord or strap 90 can be affixed to the device for securing the device to a wrist when the device is not mounted to the hand or fingers. Alternatively, a buckle (not shown) may be used to adjust the strap length, whether the strap comprises one continuous length or two separate lengths.

Figure 7:
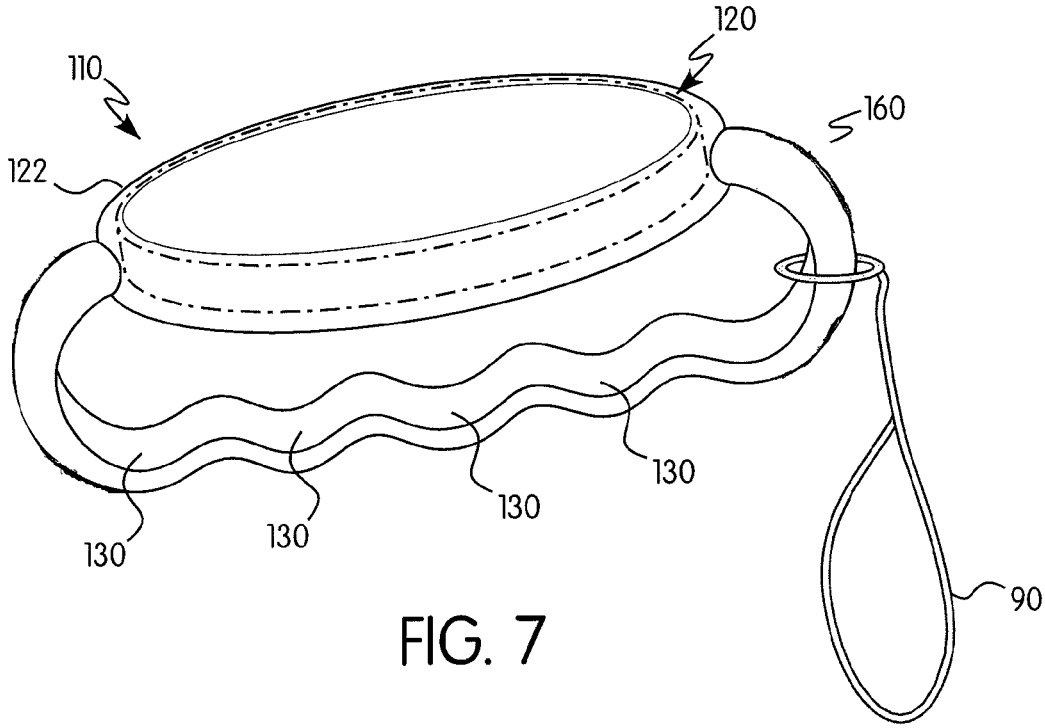
FIG. 7 is an isometric view of an alternate embodiment of the device of FIGS. 1 to 6 having a solid attachment section.

FIG. 7 illustrates an alternate embodiment of hand-mountable noise-making device 110, with a sound generating portion 120 and an attachment portion 160. In device 110, attachment portion 160 comprises a handle graspable by the fingers of a hand (not shown), the handle being integral with the container 122. Attachment portion 160 preferably includes a grippable portion that is shaped to conform to the fingers through indents 130; however, as shown, it is not adjustable in length. As with device 10 of FIGS. 1 to 6, a cord or strap 90 may also be used to secure device 110 to a wrist when device 110 is not being hand-held.

An embodiment of a second basic type of noise-making device 210 is shown in FIGS. 8 to 17, and having a sound generating portion 220 and an attachment portion 260. Attachment portion 260 is seen to be a ring having a C-shape through which a finger (not shown) is insertable so that the device is moved when the finger is moved. Preferably, two legs 262 are flexible to facilitate being mounted to and removed from a finger, and can adapt to a limited range of finger sizes. When mounted, sound generating portion 220 would extend from the attachment portion to be adjacent the back of the finger to which it is mounted.

Sound generating portion 220 comprises at least two paddles relatively movable together and apart (see FIG. 8), and, as shown in FIGS. 8 to 17, preferably comprises three paddles: a center paddle 222 and upper 224 and lower 226 paddles that move relative to center paddle 222 and strike it to generate a clapping or clacking sound when the device is waved rapidly and reciprocally.

Center paddle 222 includes a striking section or widened paddle portion 230 from which extends an elongated connecting section 232 that is affixable to attachment portion 260. Elongated connection section 232 is insertable into slot 264 of attachment portion 260. As seen best in FIG. 8, the free end of elongated connection section 232 comprises a pair of latch arms 266 that include respective latch projections 268 that latch to attachment portion 260 beyond the far end of slot 264 when elongated connection section 232 is fully inserted through slot 264.

Figure 8:
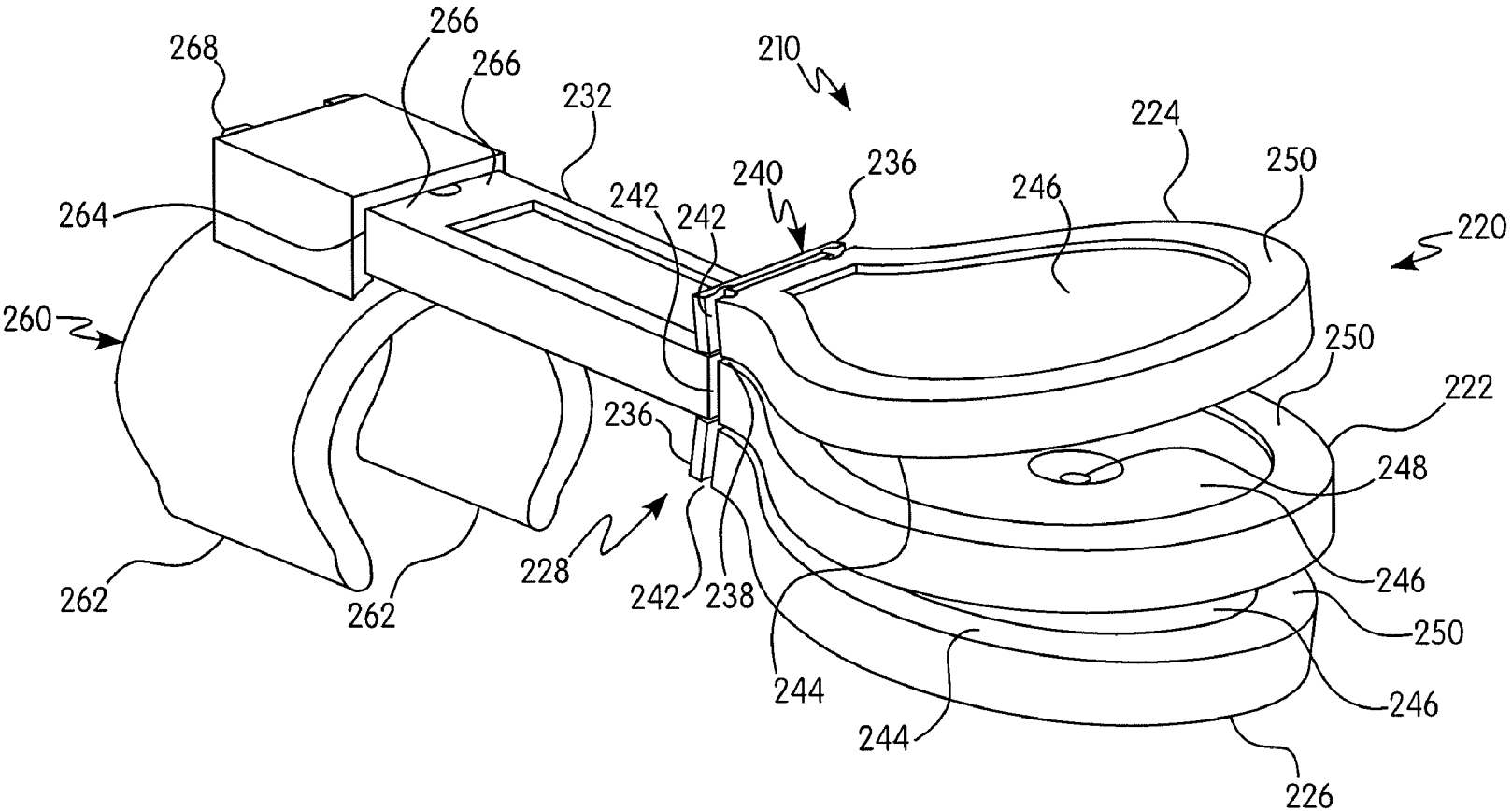
FIGS. 8 and 9 are isometric views of a third embodiment of noise-making device of the present invention, adapted to be securable to a finger.
Figure 9:
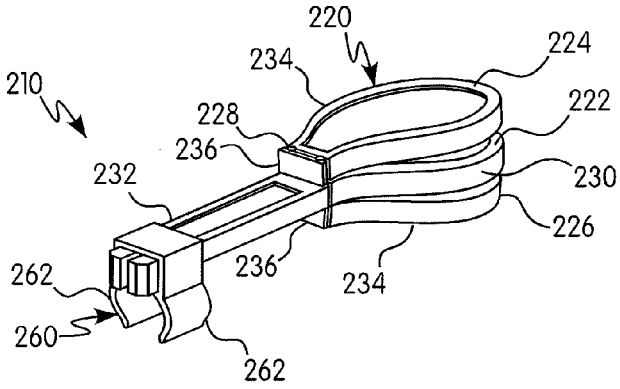
Figure 13:
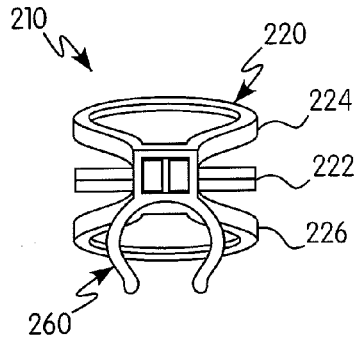
FIGS. 13 and 14 are left and right elevation views of the device of FIGS. 8 to 12.
Figure 10:
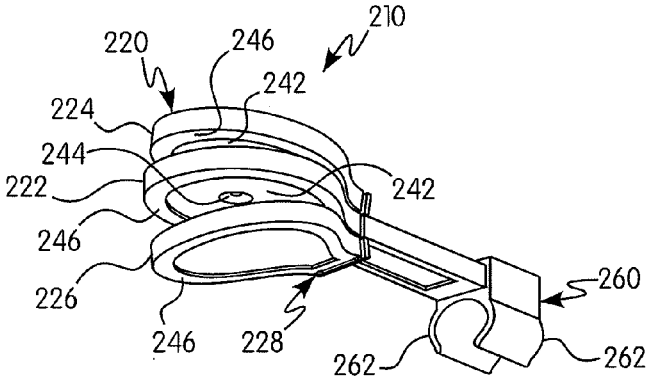
FIG. 10 is an isometric view of the device of FIGS. 8 and 9 from below thereof.
Figure 14:
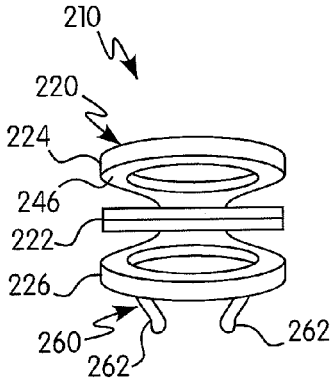
Figure 11:
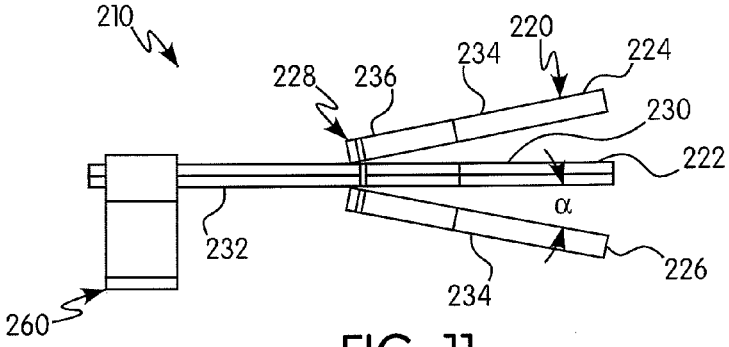
FIGS. 11 and 12 are elevation and bottom views of the device of FIGS. 8 to 11.
Figure 12:
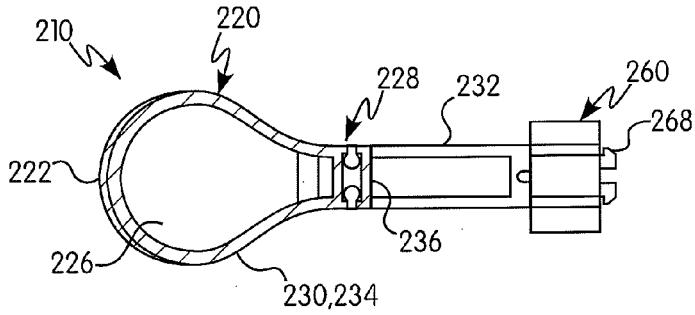
Figure 15:
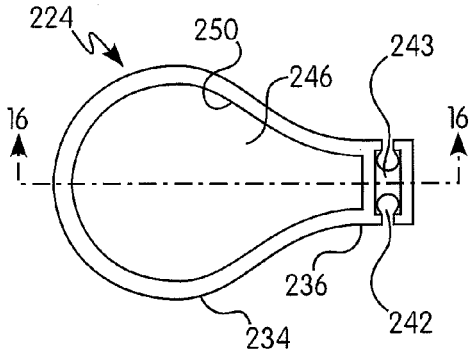
FIGS. 15 and 16 are top and sectioned elevation views of the top paddle of the device of FIGS. 8 to 14.
Figure 16:
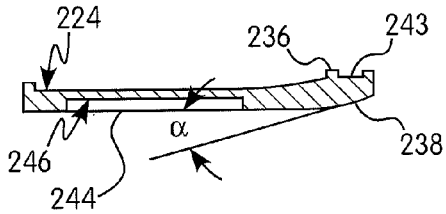
Figure 17:
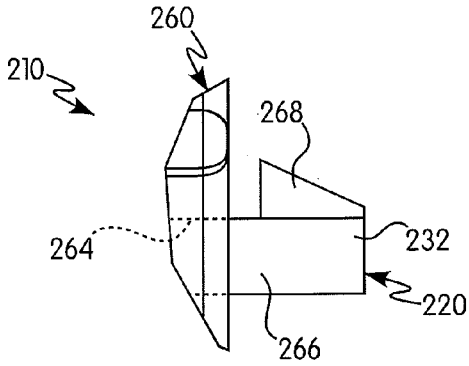
FIG. 17 is an enlarged view of the latching arrangement of the device of FIGS. 8 to 16.

Upper and lower, or outer, paddles 224,226 each have a striking section or widened paddle portion 234 and a foreshortened connecting section 236 extending therefrom. Preferably, the widened paddle portions are generally round. The two connecting sections 236 are secured to elongated connecting section 232 of center paddle 222 at paddle interconnection region 228 in a manner permitting relative reciprocating movement with respect to center paddle 222 when device 210 is waved or shaken rapidly and repeatedly. Preferably, the mode of connection is by a strong elastic band 240 that extends through small side grooves 242 of connection sections 232,236,236, as best seen in FIG. 8. Also, preferably, transverse grooves 243 are provided in outwardly facing surfaces of connection sections 236 of outer paddles 224,226 for seating of elastic band 240, as shown in FIGS. 15 and 16.

To assure movement of the upper and lower, or outer, paddles 224,226 with respect to center paddle 222, the interior surfaces 238 of the foreshortened connection sections of the outer paddles are tapered to be at an angle with the planar surfaces 244 of the outer paddles immediately adjacent to interconnection region 228 that face center paddle 222. The angle may be about 165° such that when surfaces 238 rest against elongated connection section 232 of center paddle 222, interior surfaces 244 of the outer paddles are preferably at an angle α of about 15° with respect to the plane of the surfaces of center paddle 222 when the paddles are at rest (see FIGS. 11 and 16). At this angle, when the upper and lower paddles then "rock" about the center paddle at the fulcrum, sufficient distance exists between the widened outer paddle portions 234 and widened center paddle portion 230 that a clapping or clacking sound is generated upon the striking between the widened paddle portions 230,234. The actual angle may be more or less than 15° and still be within the scope of the present invention. Also, the widened center paddle portion 230 may extend farther than the paddle portions 234 of the outer paddles.

To further enhance the loudness of the percussive sound thus generated, the surfaces of the center paddle and the outer paddles facing each other preferably have large recesses 246 defined thereinto. Optionally, center paddle 222 may include a hole 248 interconnecting the recesses of both its upper and its lower surfaces. To enhance the robustness of the paddles, a thickened flange 250 preferably is provided about the peripheries of the widened paddle portions 230,234,234, which also serves to define the recesses 246, with the connecting sections 232,236 of the paddles each preferably having generally the same height as the thickened flanges 250.

Figure 18:
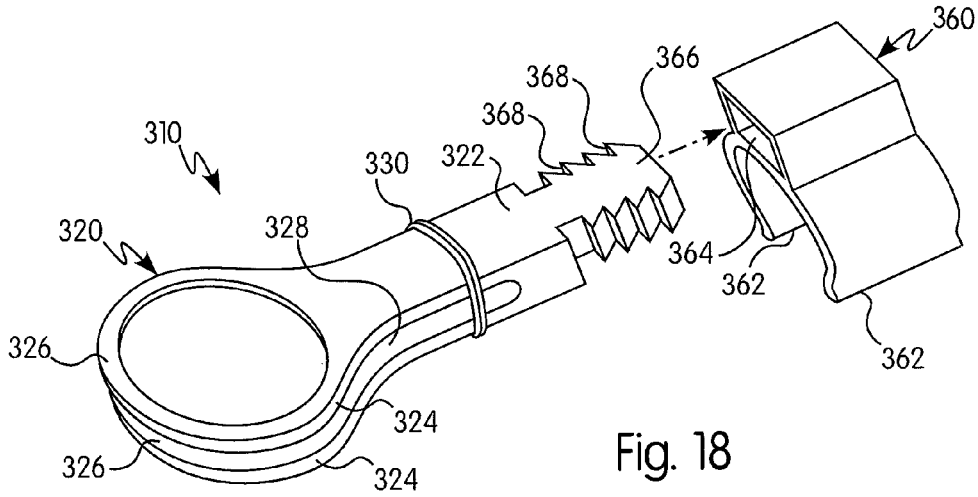
FIG. 18 is an alternate embodiment of the device of FIGS. 8 to 17.
Figure 20:
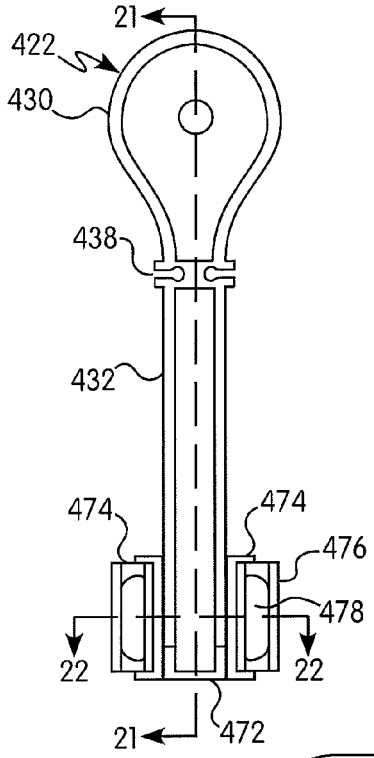
FIGS. 20 to 22 are a plan view, longitudinal section view and a cross-sectional view of the center paddle of the device of FIG. 19.
Figure 21:
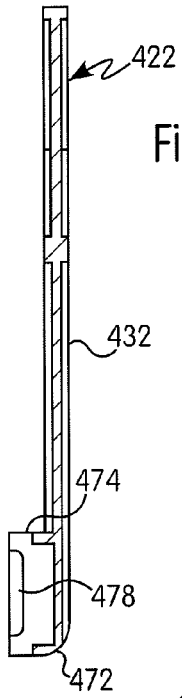
Figure 22:
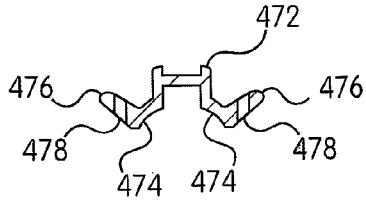

FIG. 18 illustrates an alternate embodiment of the second basic type of noise-making device 310, similar to that of FIGS. 8 to 17. Sound generating portion 320 is seen to be a one-piece integral member defining an elongated connection section 322 and a pair of paddles 324 coextending from connection section 322 to define widened paddle portions 326 that are generally round. A slot 328 divides paddles 324, whereby the paddles are relatively movable when device 310 is shaken, and the widened paddle portions 326 strike each other to generate a clapping or clacking sound as a result. An elastic band 330 is affixable to paddle ends 332 adjacent connection section 322 to provide spring bias to facilitate sound generation; preferably, paddles 324 are formed to diverge at an angle. As with device 210 of FIGS. 8 to 17, elastic band 330 is preferably seated within slots (not shown) of paddles 324. The sound generating portion 320 and the attachment portion 360 are both easily and economically molded from an appropriate plastic material that has high strength and is not brittle, to define a robust, rugged device.

Attachment portion 360 is seen to be similar to attachment portion 260 of FIGS. 8 to 17, having a pair of legs 362 forming a C-shape to be mountable to a finger. A slot 364 receives thereinto an end portion 366 of connection section 322, and as shown, end portion 366 includes arrays of teeth 368 to provide a force fit with attachment portion 360 when end portion 366 is inserted into slot 364, although a pair of latch arms (not shown) could be utilized as with device 210 to latch with attachment portion 360.

In FIGS. 19 to 23, finger-mountable device 410 is similar to device 210 in that it is finger mountable by attachment region 460, and its sound generating region 420 has three paddles 422,424,426. Center paddle 422 includes a widened paddle section 430 and an elongated connecting section 432, while outer paddles 424,426 each have a widened paddle section 434 and a foreshortened connecting section 436; outer paddles 424,426 are secured to center paddle at connection section 428 by an elastic band 440. However, attachment region 460 differs from device 210 by providing for a strap 470 secured to end 472 of elongated connecting section 432 of center paddle 422.

Figure 23:
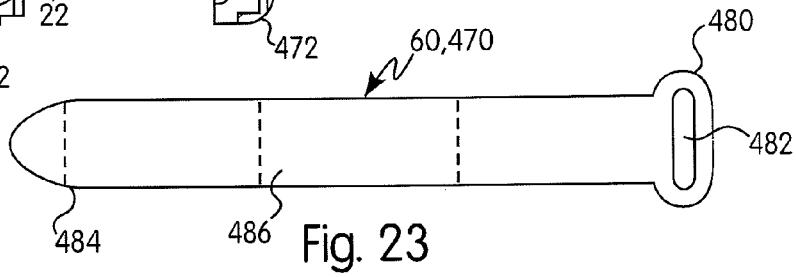
FIG. 23 is a plan view of a strap utilized with the device of FIGS. 1 to 6 and FIGS. 19 to 22.
Figure 19:
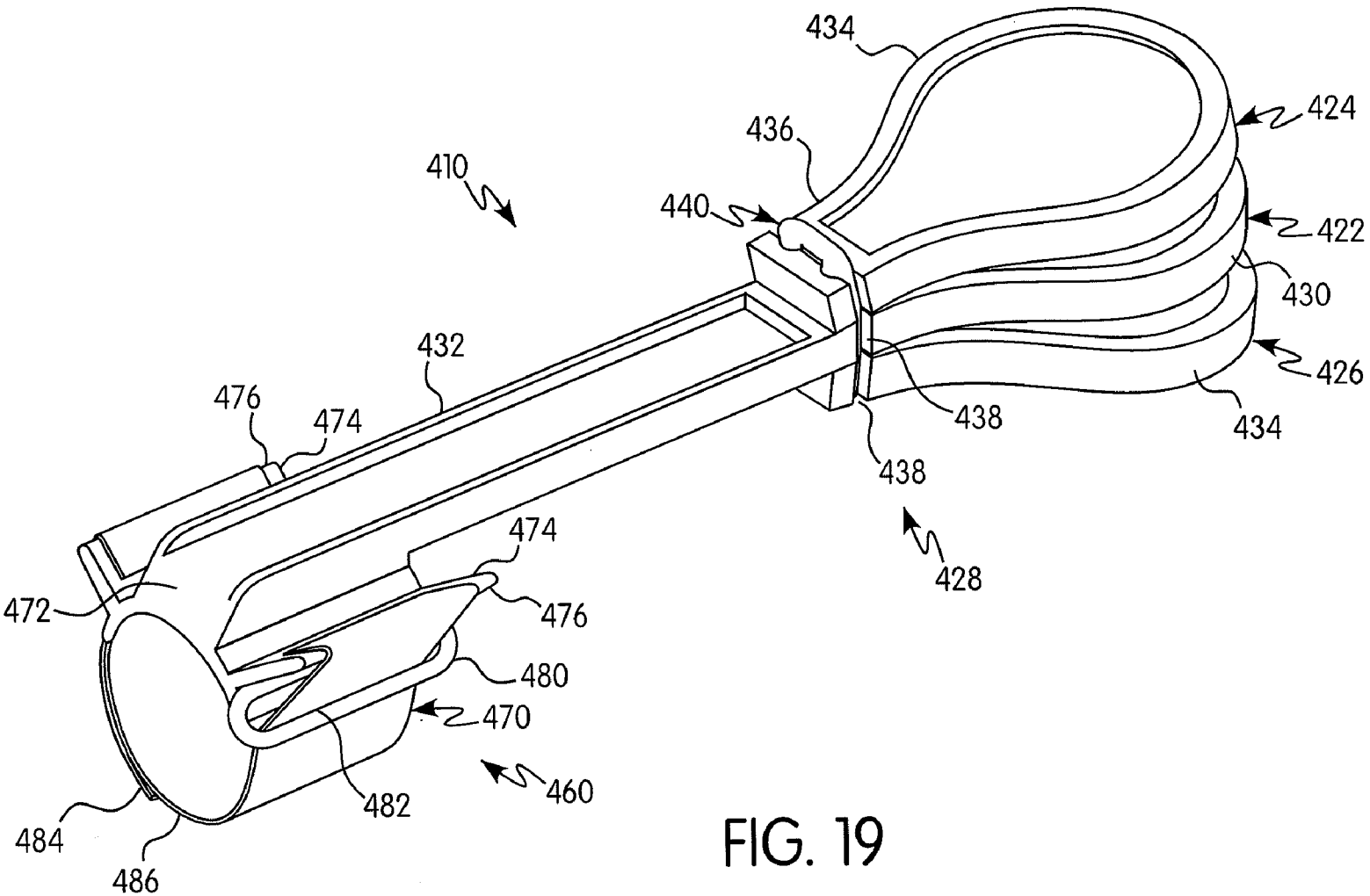
FIG. 19 is a fifth embodiment of the device, similar to those of FIGS. 8 to 18.

End 472 includes a pair of laterally protruding wings 474 extending to ends 476, and a strap-receiving slot 478 is defined in each wing 474. Strap 470, as shown in FIG. 23, includes an enlarged portion 480 at one end, through which is a slot 482. To affix the strap to the end 472, the strap is first inserted through one strap-receiving slot 478, and then is inserted through strap slot 482, then is inserted through the remaining strap-receiving slot 478, whereafter an end length 484 of strap 470 having hooks thereon is doubled back over part of an intermediate strap portion 486 having loops thereon so as to be affixed thereto through the hooks-and-loops system (i.e., VELCRO®) as described with respect to device 10 as shown in FIGS. 5 and 6. The end and intermediate strap portions may be detached and re-attached for the wearer to secure the device 410 to a finger; the hooks-and-loops arrangement thus define an adjustment mechanism, whereby the device may be utilized with fingers of a wide range of sizes.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A device for producing sound when activated by hand, finger or body movement, comprising:

a sound generating portion adapted to produce percussive sound upon rapid, reciprocating hand or finger movement; and an attachment portion adapted to removably secure the device to or directly about the hand or a finger or body portion of a person, the attachment portion including a strap attached to the sound generating portion and configured to be wrapped about the hand or fingers and an auxiliary portion attached to the sound generating portion and securable to the hand or wrist.

2. The device of claim 1, wherein the sound generating portion includes a hand- or finger-adjacent surface contoured to fit ergonomically with the adjacent portion of the hand or fingers when secured to or directly about the hand or fingers.

3. The device of claim 1, wherein the attachment portion is securable to the hand such that the sound generating portion is adjacent the back of the hand or fingers.

4. The device of claim 1, wherein the strap is adjustable in length.

5. A device for producing sound when activated by hand, finger or body movement, comprising:

a sound generating portion adapted to produce percussive sound upon rapid, reciprocating hand or finger movement; and an attachment portion adapted to removably secure the device to or directly about the hand or a finger or body portion of a person, wherein the sound generating portion is a hollow container within which is contained at least one loose, relatively dense, solid component for making sound upon striking a surrounding wall of the container and wherein the solid component is steel shot.

6. The device of claim 5, wherein the hollow container is of plastic material.

7. The device of claim 5, wherein at least the sound generating portion includes a hand- or finger-adjacent surface contoured to fit ergonomically with the adjacent portion of the hand or fingers when secured to or about the hand or fingers.

8. The device of claim 1, wherein the attachment portion is securable to or directly about one finger.

9. A device for producing sound when activated by hand, finger or body movement, comprising:

a sound generating portion adapted to produce percussive sound upon rapid, reciprocating hand or finger movement; and an attachment portion adapted to removably secure the device to or directly about the hand or a finger or body portion of a person, wherein the sound generating portion is a plurality of paddles each having a connection section and a striking section, with the connection section being connected to connection sections of the other paddles in a manner permitting the striking sections to be movable relatively freely to strike each other and wherein the connection sections are affixed to the attachment section.

10. The device of claim 9, wherein the striking sections are wider than the connection sections.

11. The device of claim 9, wherein at least one paddle includes a paddle-adjacent surface that includes a shallow cavity to enhance sound loudness.

12. The device of claim 9, having two paddles having connection sections integrally joined together near the attachment region, and the paddle portions are separated by an elongated slot thereby being relatively movable about the joint to strike each other upon vigorous shaking of the device.

13. The device of claim 12, wherein an elastic band is disposed about the connection sections to limit relative movement of the paddles.

14. The device of claim 12, wherein the attachment region includes an adjustable strap affixed to the end of the connection section, to be wrapped about a finger.

15. The device of claim 9, wherein the connection sections are interconnected by an elastic band.

16. The device of claim 9 having three paddles, wherein the center paddle has an elongated connection section extending rigidly from the striking section thereof to an attachment section connectable to the attachment portion, and wherein outer ones of the paddles are connected to the elongated connection section adjacent the striking section of the center paddle by an elastic band in a manner enabling the outer paddles to be reciprocally movable with respect to the center paddle for generating sound upon striking the center paddle.

17. The device of claim 16, wherein the striking section of the center paddle extends farther than those of the outer paddles.

18. The device of claim 16, wherein the striking sections of outer ones of the paddles at rest may each diverge from that of the center paddle by about 15°.

19. The device of claim 16, wherein the attachment portion includes a slot into which the elongated connection section of the center paddle is insertable to be affixed thereto.

20. The device of claim 19, wherein a free end of the elongated connection section includes latch projections that latch with the attachment portion beyond a far end of the slot for delatchable latching connection of the sound generating portion to the attachment portion.

21. The device of claim 16, wherein the attachment region is defined by a strap affixed to the end of the elongated connection section of the center paddle.

22. The device of claim 21, wherein the strap is affixed to the connection section at two laterally spaced-apart locations thereof and adjustable in length between the two locations.

* * * * *